US010753028B2

(12) United States Patent
Choi et al.

(10) Patent No.: US 10,753,028 B2
(45) Date of Patent: Aug. 25, 2020

(54) LAUNDRY TREATING APPARATUS

(71) Applicant: LG ELECTRONICS INC., Seoul (KR)

(72) Inventors: Heechul Choi, Seoul (KR); Dongwoo Park, Seoul (KR); Juhan Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 22 days.

(21) Appl. No.: 15/740,926

(22) PCT Filed: Jun. 29, 2016

(86) PCT No.: PCT/KR2016/006940
§ 371 (c)(1),
(2) Date: Dec. 29, 2017

(87) PCT Pub. No.: WO2017/003167
PCT Pub. Date: Jan. 5, 2017

(65) Prior Publication Data

US 2018/0195223 A1 Jul. 12, 2018

(30) Foreign Application Priority Data

Jun. 30, 2015 (KR) ..... 10-2015-0092781

(51) Int. Cl.

| | |
|---|---|
| ***D06F 31/00*** | (2006.01) |
| ***D06F 37/04*** | (2006.01) |
| ***D06F 37/22*** | (2006.01) |
| ***D06F 58/20*** | (2006.01) |
| *D06F 39/00* | (2020.01) |

(Continued)

(52) U.S. Cl.
CPC ..... *D06F 31/00* (2013.01); *D06F 37/04* (2013.01); *D06F 37/225* (2013.01); *D06F 58/203* (2013.01); *D06F 29/005* (2013.01); *D06F 33/00* (2013.01); *D06F 39/006* (2013.01); *D06F 39/125* (2013.01); *D06F 2202/12* (2013.01);

(Continued)

(58) Field of Classification Search
CPC ..... D06F 31/00
See application file for complete search history.

(56) References Cited

U.S. PATENT DOCUMENTS

| | | | |
|---|---|---|---|
| 2002/0056293 | A1 | 5/2002 | Kin et al. |
| 2007/0151300 | A1 | 7/2007 | Sunshine |

(Continued)

FOREIGN PATENT DOCUMENTS

| | | |
|---|---|---|
| EP | 1369523 | 12/2003 |
| EP | 1548174 | 6/2005 |
| EP | 2703536 | 3/2014 |

OTHER PUBLICATIONS

International Search Report and Written Opinion in International Application No. PCT/KR2016/006940, dated Oct. 20, 2016, 13 pages.

(Continued)

*Primary Examiner* — Jason Y Ko
(74) *Attorney, Agent, or Firm* — Fish & Richardson P.C.

(57) ABSTRACT

A laundry treating apparatus is disclosed, which is provided with a first treating apparatus washing laundry, a second treating apparatus arranged at a side of the first treating apparatus, washing laundry, and a third treating apparatus provided to be mounted on the second treating apparatus, drying laundry.

13 Claims, 4 Drawing Sheets

(51) Int. Cl.

| | |
|---|---|
| *D06F 39/12* | (2006.01) |
| *D06F 29/00* | (2006.01) |
| *D06F 33/00* | (2020.01) |

(52) U.S. Cl.
CPC ..... *D06F 2204/10* (2013.01); *D06F 2210/00* (2013.01); *D06F 2226/00* (2013.01)

(56) References Cited

U.S. PATENT DOCUMENTS

| | | | | |
|---|---|---|---|---|
| 2010/0011609 | A1 | 1/2010 | Park et al. | |
| 2011/0041258 | A1 | 2/2011 | Ko et al. | |
| 2011/0185511 | A1* | 8/2011 | Ryoo ..... | D06F 29/00 8/137 |
| 2012/0234054 | A1 | 9/2012 | Kim et al. | |

OTHER PUBLICATIONS

Extended European Search Report in European Appln. No. 16818200.4, dated Jan. 28, 2019, 10 pages.

* cited by examiner

[Fig. 1]
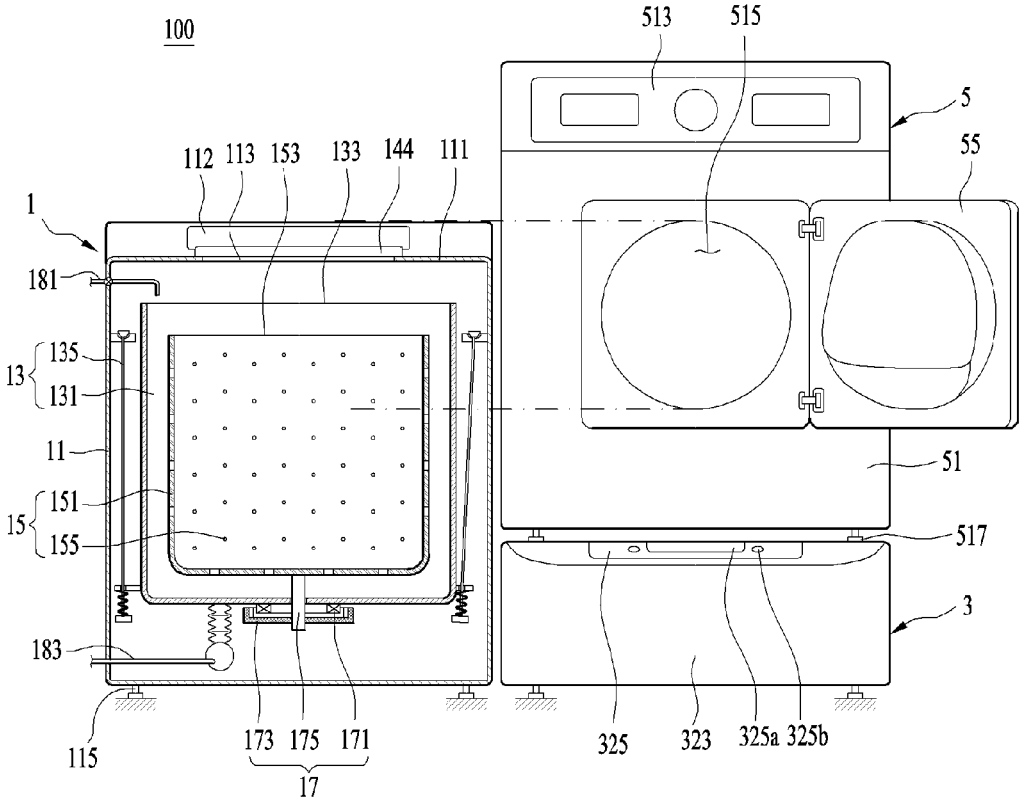

[Fig. 2]
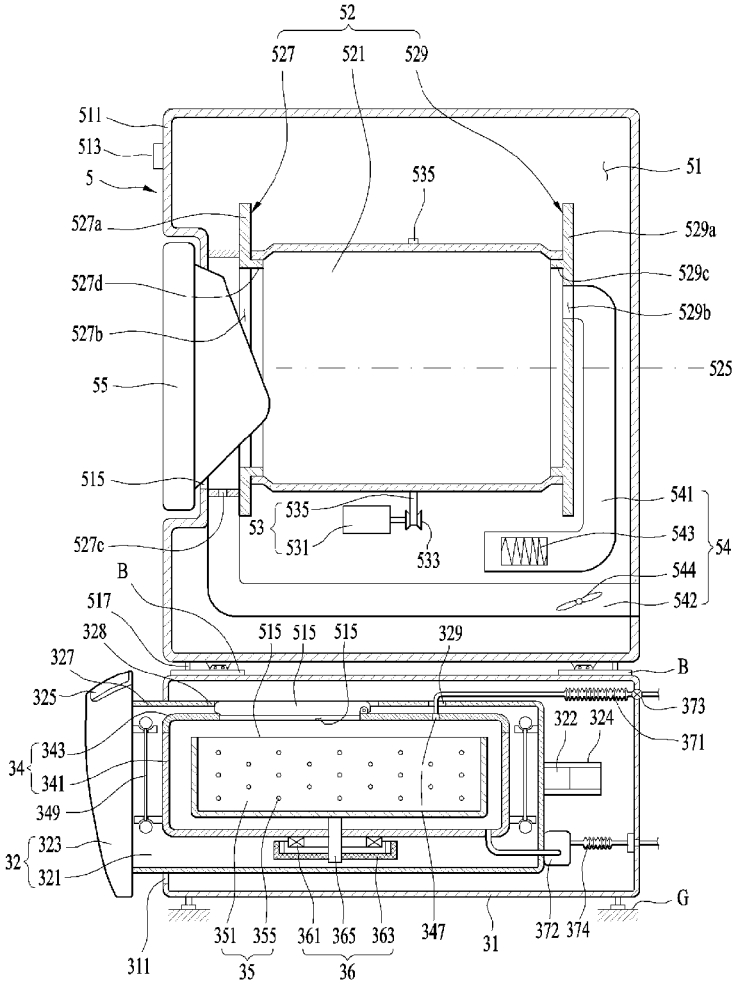

[Fig. 3]
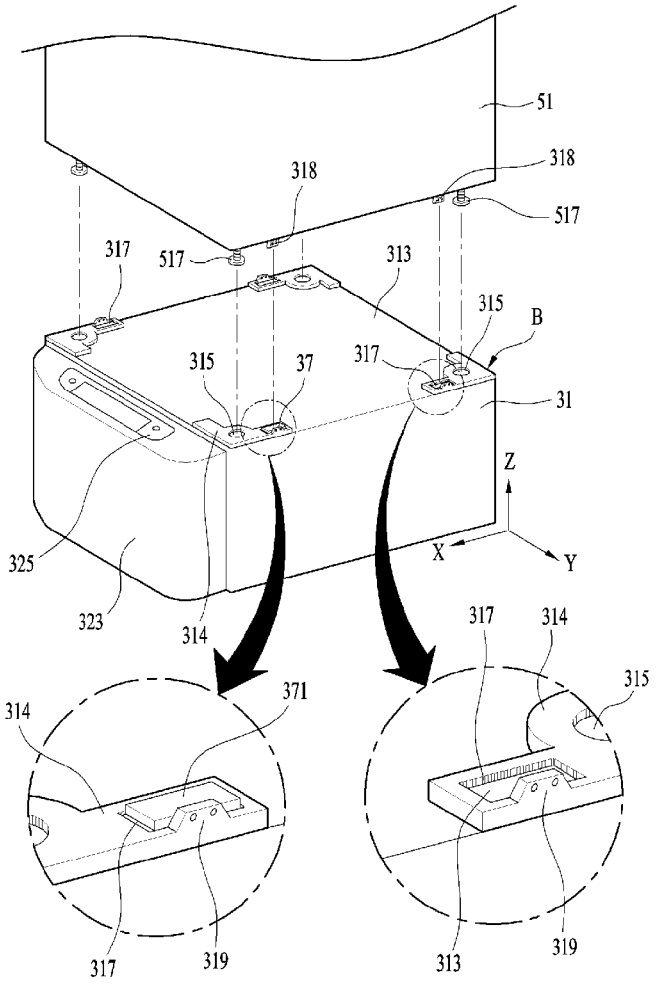

[Fig. 4]
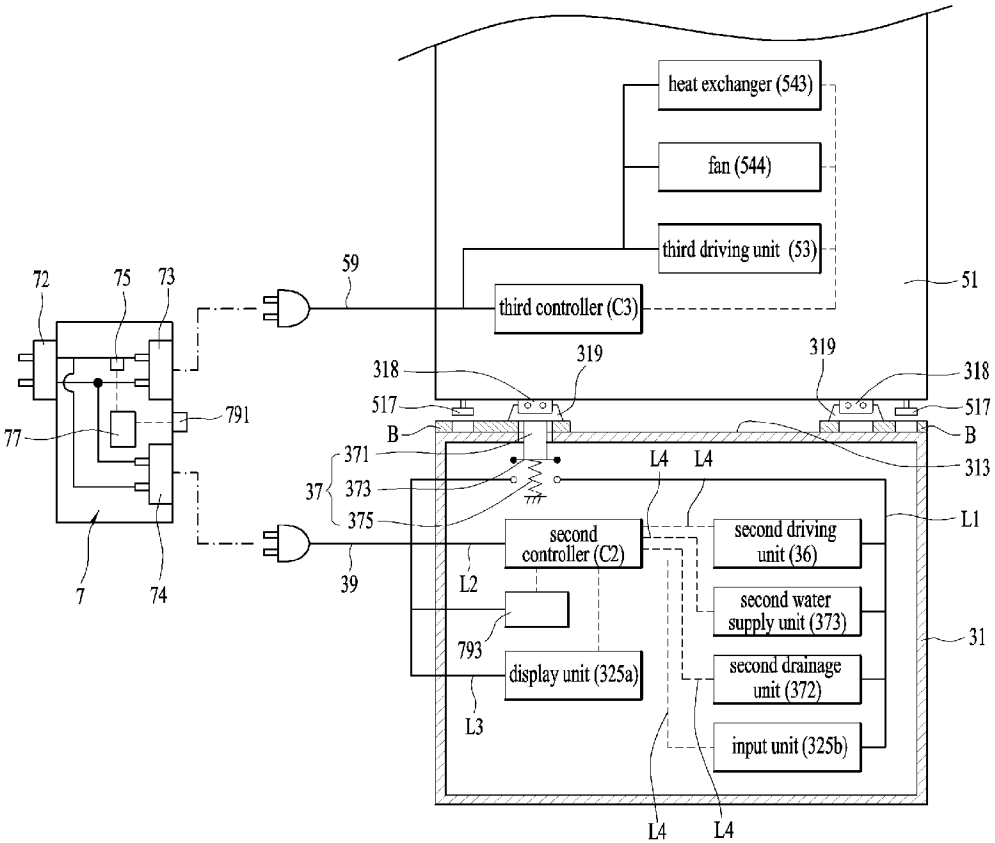

LAUNDRY TREATING APPARATUS

CROSS-REFERENCE TO RELATED APPLICATIONS

This application is the National Phase of PCT International Application No. PCT/KR2016/006940, filed on Jun. 29, 2016, which claims priority under 35 U.S.C. 119(a) to Korean Application No. 10-2015-0092781, filed on Jun. 30, 2015, which is hereby incorporated by reference herein in their entirety.

TECHNICAL FIELD

The present invention relates to a laundry treating apparatus.

BACKGROUND ART

Generally, a laundry treating apparatus includes an apparatus for washing laundry (laundry for washing or laundry for drying), an apparatus for drying laundry, and an apparatus for performing both washing and drying laundry.

A laundry treating apparatus of the related art has been categorized into a front loading type laundry treating apparatus having a laundry inlet provided in a front surface to load laundry therein and a top loading type laundry treating apparatus having a laundry inlet provided in a top side to load laundry therein.

Meanwhile, since the laundry treating apparatus of the related art should be designed to treat (wash, dry, etc.) laundry of a certain amount or more, there is limitation in reducing the volume of the laundry treating apparatus.

Due to the problem that it is difficult to reduce the volume of the laundry treating apparatus, a user who owns two laundry treating apparatuses should use the two treating apparatuses by arranging them on the ground in parallel. In this case, a problem occurs in that efficiency of a space where the laundry treating apparatus will be arranged may be reduced.

DISCLOSURE OF INVENTION

Technical Problem

The present invention is directed to a laundry treating apparatus that substantially obviates one or more problems due to limitations and disadvantages of the related art.

An object of the present invention is to provide a laundry treating apparatus in which a plurality of treating apparatuses provided with different laundry treating functions (washing of laundry, drying of laundry, etc.) are stacked up or arranged in parallel to provide complex laundry treating functions.

Another object of the present invention is to provide a laundry treating apparatus in which laundry may easily move from one treating apparatus to another treating apparatus.

Still another object of the present invention is to provide a laundry treating apparatus in which laundry having a possible migration may be washed by sorting and clothes of which washing has been finished are dried at the same time.

Further still another object of the present invention is to provide a laundry treating apparatus that may minimize vibration occurring when two treating apparatuses stacked up are operated at the same time.

Further still another object of the present invention is to provide a laundry treating apparatus in which a lower treating apparatus arranged below an upper treating apparatus may be operated only if the upper treating apparatus is mounted thereon, to minimize vibration of the lower treating apparatus.

Further still another object of the present invention is to provide a laundry treating apparatus in which it is determined that a per-hour current amount supplied to any one of two treating apparatuses is a predetermined reference current amount or more, so as to reduce or interrupt a per-hour current amount supplied to the other treating apparatus.

Solution to Problem

To achieve these objects and other advantages and in accordance with the purpose of the invention, a laundry treating apparatus comprises a first treating apparatus washing laundry, a second treating apparatus washing laundry, and a third treating apparatus drying laundry, the first treating apparatus including a first cabinet provided with a first inlet on an upper surface; a first tub provided inside the first cabinet, storing water therein; and a first drum rotatably provided inside the first tub, receiving laundry supplied to the first inlet therein, the second treating apparatus including: a second cabinet arranged at a side of the first cabinet; a drawer provided to be ejected from the second cabinet; a second tub provided inside the drawer, storing water therein; a second inlet provided on an upper surface of the second tub; and a second drum rotatably provided inside the second tub, receiving laundry supplied to the second inlet therein, and the third treating apparatus including: a third cabinet provided with a third inlet on a front surface, mounted on an upper surface of the second cabinet and arranged at a side of the first cabinet; a third drum provided inside the third cabinet, providing a space in which laundry supplied to the third inlet is received; and a drying unit supplying the air to the third drum.

The first inlet may be arranged between the lowest end of the third inlet and the uppermost end of the third inlet.

The second drum may be rotated around a shaft orthogonal to the bottom of the second cabinet, and the third drum may be rotated around a shaft parallel with the bottom of the third cabinet.

The second treating apparatus may further include a second treating apparatus driving unit rotating the second drum, a second treating apparatus controller controlling the second treating apparatus driving unit, and a connector allowing the second treating apparatus controller to control an operation of the second treating apparatus driving unit only if the third treating apparatus is mounted on an upper surface of the second treating apparatus.

The connector may be provided to open or close a circuit, which supplies a power to the second treating apparatus driving unit, depending on whether the third cabinet is arranged on the second cabinet.

The laundry treating apparatus further comprises a first connector provided on the bottom of the third cabinet, and a second connector provided on the upper surface of the second cabinet and detachably fixed to the first connector, wherein the connector includes a pressurizer provided to pass through the upper surface of the second cabinet and pressurized by the first connector, and a switching unit inlet or closing the circuit, which supplies a power to the second treating apparatus, depending on a position of the pressuring unit.

The connector may open or close a control circuit, which connects the second treating apparatus controller with the second treating apparatus driving unit, depending on whether the third cabinet is mounted on the upper surface of the second cabinet.

The laundry treating apparatus may further comprise a second treating apparatus power line supplying a power to the second treating apparatus, a third treating apparatus power line supplying the power to the third treating apparatus, and a power controller interrupting the power supplied to the second treating apparatus power line if a per-hour current amount supplied to the third treating apparatus power line is a predetermined reference current amount or more.

The laundry treating apparatus further comprises a second treating apparatus power line supplying a power to the second treating apparatus, a third treating apparatus power line supplying the power to the third treating apparatus, and a power controller transmitting, to the second treating apparatus, the fact that a per-hour current amount supplied to the third treating apparatus power line is a predetermined reference current amount or more if the per-hour current amount supplied to the third treating apparatus power line is the predetermined reference current amount or more.

The drying unit may include a heat exchanger and a fan, which supply the heated air to the third drum, and the reference current amount may be set to a value less than a per-hour current amount required for the operation of the heat exchanger and the fan.

The laundry treating apparatus may further comprise a second treating apparatus controller supplying the power to the second treating apparatus but temporarily interrupting the operation of the second treating apparatus if the per-hour current amount supplied to the third treating apparatus power line is the reference current amount or more.

The second treating apparatus controller may be provided to perform wire or wireless communication with the power controller.

Advantageous Effects of Invention

According to the present invention, a laundry treating apparatus may be provided, in which a plurality of treating apparatuses provided with different laundry treating functions are stacked up or arranged in parallel to provide complex laundry treating functions.

Also, according to the present invention, a laundry treating apparatus may be provided, in which laundry may easily move from one treating apparatus to another treating apparatus.

Also, according to the present invention, a laundry treating apparatus may be provided, in which laundry having a possible migration may be washed by sorting and clothes of which washing has been finished are dried at the same time.

Also, according to the present invention, a laundry treating apparatus may be provided, which may minimize vibration occurring when two treating apparatuses stacked up are operated at the same time.

Also, according to the present invention, a laundry treating apparatus may be provided, in which a lower treating apparatus arranged below an upper treating apparatus may be operated only if the upper treating apparatus is mounted thereon, to minimize vibration of the lower treating apparatus.

Also, according to the present invention, a laundry treating apparatus may be provided, in which it is determined that a per-hour current amount supplied to any one of two treating apparatuses is a predetermined reference current amount or more, so as to reduce or shut off a per-hour current amount supplied to the other treating apparatus.

BRIEF DESCRIPTION OF DRAWINGS

FIG. 1 illustrates an example of a laundry treating apparatus according to the present invention.

FIG. 2 illustrates an example of second and third laundry treating apparatuses provided in the present invention.

FIG. 3 illustrates an example of a coupling structure of second and third treating apparatuses provided in the present invention.

FIG. 4 illustrates an example of a connector provided in a second treating apparatus.

BEST MODE FOR CARRYING OUT THE INVENTION

Reference will now be made in detail to the preferred embodiments of the present invention, examples of which are illustrated in the accompanying drawings. Meanwhile, elements or control method of apparatuses which will be described below are only intended to describe the embodiments of the present invention and are not intended to restrict the scope of the present invention. Wherever possible, the same reference numbers will be used throughout the drawings to refer to the same or like parts.

As shown in FIG. 1, a laundry treating apparatus 100 according to the present invention may include a first treating apparatus 1 for washing laundry, a second treating apparatus 3 arranged at a side of the first treating apparatus to wash laundry, and a third treating apparatus 5 arranged on an upper surface of the second treating apparatus 3 to dry laundry.

The first treating apparatus 1 may include a first cabinet 11 constituting appearance, a first tub 13 provided inside the first cabinet 11, storing washing water therein, a first drum 15 provided inside the first tub 13, receiving laundry therein, and a first driving unit 17 rotating the first drum 15.

The first cabinet 11 may include a cover 111 constituting an upper portion of the first treating apparatus 1. The cover 111 may include a first inlet 113 supplying laundry to the first drum 15 or taking out laundry stored in the first drum 15, and a first control panel 112 controlling an operation of the first treating apparatus 1. The first inlet 113 is opened or closed by a first treating apparatus door 114 (first door) rotatably provided in the first cabinet 11.

A height controller 115 may be provided on the bottom of the first cabinet 11. A user may control or level a height of the first cabinet 11 through the height controller 115.

The first tub 13 may be provided in all shapes that may store washing water therein, and is supplied with washing water through a first water supply unit 181 and discharges washing water to the outside of the first cabinet 11 through a first drainage unit 183.

The first tub 13 includes a first tub body 131 of a cylindrical shape, and a first tub inlet 133 provided in the first tub body 131 and communicated with the first inlet 113. The first tub body 131 may be fixed into the first cabinet 11 through a first tub support unit 135. It is preferable that the first tub support unit 135 is provided in a structure that may absorb vibration generated in the tub.

The first tub inlet 133 may be provided in all shapes that may load laundry supplied from the first inlet 113 into the first tub body. In an example of the drawing, the first tub inlet 133 is provided as an opened upper surface of the first tub body 131.

The first drum 15 may include a first drum body 151 arranged inside the first tub 13, receiving laundry therein. Since the first drum body 151 is rotated inside the first tub body 131 by the first driving unit 17, it is preferable that the first drum body 151 is provided in a cylindrical shape.

The first drum body 151 may be provided with a first drum inlet 143 communicated with the first tub inlet 133 and the first tub inlet 113, and its circumference may be provided with a through hole 155 that allows washing water supplied to the first tub body 131 to flow into the first drum body 151.

The first drum inlet 153 may be provided in all shapes that may communicate the first tub inlet 133 with the inside of the first drum body 151. In the drawing, the first drum inlet 153 is exemplarily provided as an opened surface arranged on the first drum body 151.

The aforementioned first drum 15 is rotated inside the first tub 13 by the first driving unit 17. The first driving unit 17 may include a stator 171 fixed to an external bottom of the first tub 13, forming a rotating magnetic field, a rotor 173 rotated by the rotating magnetic field, and a first drum rotational shaft 175 provided to pass through the bottom of the first tub 13, connecting the rotor 173 with the first drum body 151.

If the first treating apparatus 1 is provided in a top loading type in which the first inlet 113 is arranged in the cover 111 (upper surface of the first cabinet), it is preferable that the first drum rotational shaft 175 is provided to be orthogonal to the bottom of the cabinet.

In the first treating apparatus 1 having the aforementioned structure, a first controller C1 (first treating apparatus controller, see FIG. 4) washes laundry by rotating the first drum 15 through the first driving unit 17 after supplying washing water to the first tub 13 through the first water supply unit 181. Afterwards, the first controller C1 discharges out washing water to the outside of the first tub through the first drainage unit 183 and then dehydrates laundry by rotating the first drum 15 through the first driving unit 17.

Each of the elements 17, 181, 183, 112, etc. provided in the first treating apparatus including the first controller (not shown) is supplied with a power through a first power line (not shown).

As shown in FIG. 2, the second treating apparatus 3 may include a second cabinet 31 arranged at a side of the first treating apparatus 1 and supported on the ground G, a drawer 32 able to be ejected from the second cabinet 31, a second tub 34 arranged inside the drawer 32, storing washing water therein, and a second drum 35 provided inside the second tub 34, storing laundry therein.

A front through hole 311 is provided on a front surface of the second cabinet 31, and the drawer 32 may be ejected from or inserted into the second cabinet 31 through the front through hole 311.

The drawer 32 includes a drawer body 321 of which upper surface is opened, and a drawer cover 327 provided in an opened surface of the drawer body 321, forming an upper surface of the drawer body 321.

The drawer body 321 is detachably coupled to the second cabinet 31 through a rail 322 and a rail support unit 324, wherein the rail support unit 324 may be provided to be fixed to the second cabinet, and the rail 322 may be fixed to the drawer body 321 so as to be ejected from the rail support unit 324.

A drawer panel 323 is provided on a front surface of the drawer body 321, and may serve as a means for opening or closing the front through hole 311 and at the same time a handle for ejecting or inserting the drawer body 321 from or into the second cabinet 31.

The drawer panel 323 may be provided with a second control panel 325 for controlling an operation of the second treating apparatus 3. The second control panel 325 is provided with a means (second treating apparatus controller) for controlling a second water supply unit, a second drainage unit, and a second driving unit, which will be described later.

Meanwhile, the second control panel 325 may be provided with an input unit 325*b* for allowing a user to input a control command to the second treating apparatus 3 and a display unit 325*a* for notifying a user of acknowledgement of the control command input through the input unit 325*b* or a process of implementing the control command input by the user.

The drawer cover 327 is provided with first and second through holes 328 and 329, which are provided to pass through the drawer cover 327 and communicate the inside of the drawer body 321 with the outside of the drawer body 321. Functions of the first and second through holes 328 and 329 will be described later.

The second tub 34 may include a second tub body 341 fixed into the drawer 32 by a second tub support unit 349, and a tub cover 343 forming an upper surface of the second tub body 341.

If the first treating apparatus 1 and the second treating apparatus 3 are provided to wash laundry, the volume of the second tub 34 may be set to be the same as that of the first tub 13 but may be set to be smaller than that of the first tub 13.

That is, since the volume of the first tub and the volume of the second tub should be set in accordance with a drying capacity of the third treating apparatus 5 which will be described later, if the third treating apparatus 5 has a great drying capacity (if the third drum is able to receive laundry ejected from the first treating apparatus and the second treating apparatus), the volume of the first tub may be provided to be the same as that of the second tub. However, if not so, it is preferable that the volume of the second tub is provided to be smaller than that of the first tub.

The tub cover 343 is provided with a second tub inlet 345 (second inlet) provided to communicate the inside of the second tub body 341 with the outside thereof, wherein the second inlet 345 is opened or closed by a second treating apparatus door 348 (second door).

Since the second inlet 345 is arranged below the first through hole 328, the second drawer 348 may be rotated with respect to the outside of the drawer 32 through the first through hole 328 provided in the drawer cover 25. Therefore, the user may load laundry into the second tub 34 by ejecting the drawer 32 from the second cabinet 31 and then opening the second door 348.

Meanwhile, a supply inlet 347 connected with a water supply pipe 371 is further provided on the upper surface of the second tub 34. The water supply pipe 371 is a means for connecting a water supply source with the supply inlet 347, and is inserted into the drawer through the second through hole 329 provided in the drawer cover.

The second drum 35 may include a second drum body 351 of a cylindrical shape, a second drum inlet 353 provided on an upper surface of the second drum body 351, and a plurality of through holes 355 provided to pass through the second drum body 351.

Since the second drum inlet 353 is arranged below the second inlet 345, the second drum inlet 353 serves as a passage through which laundry is supplied to the second drum body 351, and the through holes 355 serves as passages through which washing water inside the second tub 34 flows into the second drum body 351.

The second drum body 351 may be rotated by the second driving unit 36. The second driving unit 36 may include a stator 361 fixed to the second tub 34, forming a rotating magnetic field, a rotor 363 rotated by the rotating magnetic field, and a second drum rotational shaft 365 connecting the bottom of the second drum body 351 with the rotor 363 by passing through the second tub 34. As shown, the second drum rotational shaft 365 may be provided to be orthogonal to the bottom of the drawer 32.

The second tub 34 is supplied with washing water through the second water supply unit, and discharges out the washing water through the second drainage unit, wherein the second water supply unit may include a water supply pipe 371 for connecting a water supply source (not shown) with the supply inlet 347, and a water supply valve 373 for opening or closing the water supply pipe 371 through the second controller C2 (controller of the second treating apparatus, see FIG. 4).

The second drainage unit may include a drainage pipe 374 guiding washing water inside the second tub 34 to the outside of the second cabinet 31, and a drainage pump 372 for discharging out the washing water inside the second tub 34 in accordance with a control signal of the second treating apparatus controller.

Meanwhile, since the drawer 32 provided in the second treating apparatus 3 should be provided to be ejected from the second cabinet 31, it is preferable that the water supply pipe 371 and the drainage pipe 374 are provided in a retractile structure or are made of an elastic material.

The third treating apparatus 5 arranged on the upper surface of the second treating apparatus 3 is to dry laundry of which washing has been finished. The laundry treating apparatus 100 of the present invention is characterized in that laundry having a passible migration is washed respectively by the first treating apparatus 1 and the second treating apparatus and laundry of which washing has been finished may be dried by the third treating apparatus 5.

The migration means that a dye existing in laundry moves to another laundry during washing. Since this migration barely occurs during drying of laundry unlike washing, even though the laundry washed respectively by the first and second treating apparatuses is dried by one apparatus 5 at the same time, the migration will not occur.

The third treating apparatus 5 includes a third cabinet 51 arranged on the upper surface of the second cabinet 31, a third drum 52 provided inside the third cabinet, storing laundry therein, and a drying unit 54 supplying the air to the third drum 52.

The third cabinet 51 is provided with a front panel 511 that forms a front surface of the third treating apparatus, wherein the front panel 511 may include a third inlet 515 serving as a passage through which laundry is loaded into the third drum 52, and a third control panel 513 for controlling the operation of the third treating apparatus.

The third inlet 515 is opened or closed by a third treating apparatus door 55 (third door), and the third control panel 513 may include a means (controller of the third treating apparatus) for controlling the drying unit 54 and a third driving unit 53, which will be described later.

Since the third treating apparatus 5 is arranged on the second treating apparatus 3, if the third inlet 515 and the third control panel 513 are provided on the upper surface of the third cabinet 51, inconvenience may be caused in accordance with a height of a user when laundry is loaded into the third inlet 515 or a control command is input through the third control panel 513. Therefore, the third inlet 515 and the third control panel 513 are arranged on the front surface of the front panel 511 to minimize such a problem.

Meanwhile, the first inlet 113 may be provided to have a position relation with the third inlet 515 as shown in FIG. 1, whereby the laundry ejected from the first drum through the first inlet 113 may easily be supplied to the third drum through the third inlet 515. That is, the first inlet 113 is preferably provided in the first cabinet, whereby the first inlet 113 may be arranged between the lowest end of the third inlet 515 and the uppermost end of the third inlet 515.

A height controller 517 (third cabinet height controller) may be provided on the bottom of the third cabinet 51. The user may control or level a height of the third cabinet 51 through the height controller 517.

The third drum 52 may be provided as a drum body 521 that provides a space for receiving laundry therein. If both surfaces where the drum body 521 faces are provided in an opened cylindrical shape, the opened surface arranged at the front of the drum body 521 may be supported by a front support unit 527, and the opened surface arranged at the rear of the drum body 521 may be supported by a rear support unit 529.

The front support unit 527 may include a first support body 527*a* fixed into the third cabinet, a body through hole 527*b* provided to pass through the first support body 527*a*, communicating the third inlet 515 with the third drum 52, and a front flange 527*d* provided on the circumference of the body through hole 527*b*, rotatably supporting the opened front surface of the third drum 52.

The rear support unit 529 may include a second support body 529*a* fixed into the third cabinet, and a rear flange 529*c* provided in the second support body, rotatably supporting the opened rear surface of the third drum 52.

The drying unit 54 may include air discharge units 542 and 544 discharging out the air of the third drum through the front support unit 527, and air supply units 541 and 543 supplying the air to the third drum through the rear support unit 529.

In this case, the front support unit 527 should further include a discharge hole 527*c* for discharging the air inside the third drum 52 to the air discharge unit, and the rear support unit 529 should further include an inlet hole 529*b* for allowing the air discharged from the air supply unit to flow into the third drum 52.

The air supply unit may include a supply duct 541 connected with the inlet hole 529*b*, and a heat exchanger 543 heating the air flown to the supply duct 541.

The air discharge unit may include a discharge duct 542 guiding the air, which is flown to the discharge hole 527*c*, to the outside of the third cabinet 51, and a fan 544 provided in the discharge duct, moving the air inside the third drum 52 to the discharge duct.

Meanwhile, unlike the aforementioned description, the drying unit 54 may be provided to dehumidify and heat the air discharged from the third drum 52 and then resupply the air to the third drum 52. In this case, the discharge duct 542 should be connected to the supply duct 541 (free end of the supply duct should be connected with the discharge duct), and the heat exchanger 543 may be provided to include a dehumidifying unit for removing moisture included in the air by cooling the air inside the discharge duct, and a heating unit for heating the air that has passed through the dehumidifying unit.

The third drum 52 may be rotated by the third driving unit 53. That is, the third driving unit 53 may include a motor 531, a pulley 533 rotated by the motor 531, and a belt 535 connecting a circumference of the pulley with the circumference of the third drum.

In the laundry treating apparatus 100 having the aforementioned structure, if the third drum 52 is rotated to dry laundry, vibration may occur in the third cabinet 51. The greater the vibration occurring in the third cabinet 51 becomes, the greater the risk of the third treating apparatus 5 to be dropped from the second treating apparatus 3 becomes. To avoid this risk, it is preferable that the third treating apparatus 5 and the second treating apparatus 3 are coupled to each other through a cabinet fastening unit B.

If the third treating apparatus 5 is coupled to the second treating apparatus 5 through the cabinet fastening unit B, the risk of the third treating apparatus 5 to be dropped from the second treating apparatus 3 is minimized.

Also, since the third treating apparatus 5 mounted on the second cabinet 31 will serve to absorb or reduce vibration occurring in the second treating apparatus 3, vibration of the second treating apparatus 3 may be minimized through the cabinet fastening unit B in the present invention.

Meanwhile, if the drawer 32 is ejected from the second cabinet 31 in a state that the third treating apparatus is not mounted on the second treating apparatus, the center of gravity of the second treating apparatus 3 moves to the front of the second cabinet 31, whereby the rear of the second treating apparatus 3 may be detached from the ground. Therefore, the cabinet fastening unit B serves as a means for solving the problem that the rear of the second treating apparatus 3 is detached from the ground when the drawer 31 is ejected from the second cabinet 32.

As shown in FIG. 3, the cabinet fastening unit B may include a first connector 318 provided in the third cabinet 51, a fastening body 314 fixed to an upper surface 313 of the second cabinet, and a second connector 319 provided in the fastening body 314 and coupled to the first connector 318.

Meanwhile, if the height controller 517 is provided on the bottom of the third treating apparatus, the cabinet fastening unit B may further include a controller receptacle 315 for receiving the height controller 517 therein.

The controller receptacle 315 may be provided as a groove obtained as the surface of the fastening body 314 is recessed, or may be provided as a hole that passes through the fastening body 314.

Since the aforementioned advantages intended through the cabinet fastening unit B cannot be achieved if the user detaches the third treating apparatus 5 from the second treating apparatus 3, the laundry treating apparatus 100 of the present invention may further include a connector 37 for allowing the second treating apparatus 3 to be operated only if the third treating apparatus 5 is arranged on the second treating apparatus 3.

As shown in FIG. 4, the connector 37 may be provided to open or close a first circuit L1 provided to supply a power to the respective elements 36, 373, 372, 325*b*, etc. provided in the second treating apparatus.

The first circuit L1 may be provided to be supplied with a power through a second treating apparatus power line 39 (second power line), and may be provided as a circuit that supplies a power to the elements except the second controller C2 and the display unit 325*a* among the elements 36, 373, 372, 325*b*, etc. provided in the second treating apparatus 3, requiring a power supply. That is, the second controller C2 may be provided to be always supplied with a power through a second circuit L2, and the display unit 325*a* may be provided to be always supplied with a power through a third circuit L3.

As one example, the connector 37 of FIG. 4 closes the first circuit L1 if the third treating apparatus 5 is mounted on the upper surface 313 of the second treating apparatus 3, and opens the first circuit L1 if the first treating apparatus 1 is detached from the upper surface 313 of the second treating apparatus 3.

The connector 37 may include a pressurizer 317 provided to pass through the upper surface 313 of the second cabinet and pressurized by the first connector 318, a switching unit 373 provided in the pressurizer 317, opening or closing the first circuit L1, and an elastic support unit 375 pressurizing the switching unit 373 in a direction far away from the first circuit L1.

If the pressurizer 371 is provided to be pressurized by the first connector 318 provided on the bottom of the first treating apparatus without being pressurized by a separate device provided in the first treating apparatus, the cabinet fastening unit B may further include a pressurizer receptacle 317 where the pressurizer 371 is arranged, as shown in FIG. 3. That is, the pressurizer receptacle 317 may be provided to pass through the fastening body 314.

Two or more of the aforementioned connector 37 may be provided in the second treating apparatus 3, or one connector 37 may be provided in the second treating apparatus 3 as shown in FIG. 3.

Meanwhile, unlike FIG. 4, the connector 37 may be provided to open or close the second power line 39 that supplies the power to the elements 36, 373, 372, 325*b*, etc. provided in the second treating apparatus 3, or may be provided to open or close a control circuit L4 that connects the second controller C2 with the elements 361, 373, 372, 325*b*, etc.

The aforementioned second treating apparatus 3 and third treating apparatus 5 may prevent vibration from being amplified because their drums' centers of rotation are not arranged on the same line.

The center of rotation (second drum shaft 365) of the second drum provided in the second treating apparatus is formed to be orthogonal to the ground. It is assumed that the center of rotation of the third drum is also formed to be orthogonal to the ground.

If a rotational direction of the second drum 35 is the same as that of the third drum 52, a direction of a repulsive force generated in the second cabinet by rotation of the second drum is the same as that of a repulsive force generated in the third cabinet by rotation of the third drum, whereby the second treating apparatus 3 and the third treating apparatus 5, which are coupled to each other, may be overturned.

However, since the center of rotation 525 (see FIG. 2) of the third drum provided in the present invention is provided in parallel with the bottom of the third cabinet 51 unlike the second drum rotational shaft 365, the aforementioned problem is avoided.

Meanwhile, the laundry treating apparatus 100 of the present invention may further include a power control device 7 for controlling the power supplied to the second treating apparatus 3 by determining, through a third treating apparatus power line 59 (third power line), whether a per-hour current amount supplied to the third treating apparatus 5 is a predetermined reference current amount or more.

As shown in FIG. 4, the elements 543, 544 and 53, etc. provided in the third treating apparatus, requiring a power supply and a third controller C3 (third treating apparatus controller) are connected to a power source (not shown) through the third power line 59. The power source supplying a power to an indoor home appliance is connected to a power interruption unit (not shown), which is designed to prevent an accident such as fire from being generated by interrupting the power supplied to the power source if a per-hour current amount supplied to the home appliance exceeds a predetermined value (interruption current amount).

Since the third treating apparatus 5 provided in the present invention is provided with a drying unit 54 that requires much per-hour current amount, if the third treating apparatus 5 and the second treating apparatus 3 are operated at the same time, the per-hour current amount supplied to the laundry treating apparatus 100 is likely to exceed the interruption current amount. If the per-hour current amount supplied to the laundry treating apparatus 100 reaches the interruption current amount, since the power interruption unit will interrupt the power supplied to the laundry treating apparatus 100, operations of all of the first treating apparatus 1, the second treating apparatus 3 and the third treating apparatus 5 may be stopped.

To solve the problem, the power control device 7 may be provided to interrupt the power supplied to the second treating apparatus 3 if the per-hour current amount supplied to the third treating apparatus 5 is the reference current amount (value the same as or smaller than the interruption current amount) or more.

Meanwhile, if the per-hour current amount supplied to the third treating apparatus 5 is the reference current amount or more, the power control device 7 may be provided to notify the second controller C2 of the above fact, and the second controller C2 may be provided to temporarily interrupt the operation of at least some of the elements 36, 373, 372 and 325*b* of the second treating apparatus.

This is intended to prevent the per-hour current amount supplied to the laundry treating apparatus 100 from reaching the interruption current amount and also prevent the power supplied to the second treating apparatus 3 from being interrupted (prevent a washing course which is being performed by the second treating apparatus from ending).

To this end, the power control device 7, as shown in FIG. 4, includes a power input unit 72 detachably coupled to the power source (not shown), a third power line detachable unit 73 to which the third power line 59 is detachably fixed, electrically connecting the third power line 59 to the power input unit 72, a second power line detachable unit 74 to which the second power line 39 is detachably fixed, electrically connecting the second power line 39 to the power input unit 72, and a sensing unit 75 measuring a per-hour current amount supplied to the third treating apparatus.

The sensing unit 75 is arranged in a circuit that connects the power input unit 72 with the third power line detachable unit 73 and measures a per-hour current amount supplied to the third power line 59.

Data on the per-hour current amount measured by the sensing unit 75 are transmitted to a power controller 77, and the power controller 77 compares the received per-hour current amount data with a predetermined reference current amount.

If the per-hour current amount measured by the sensing unit 75 is the reference current amount or more, the power controller 77 transmits a signal, which requests the second controller C2 to reduce the per-hour current amount of the second treating apparatus through a communication unit. The communication unit may include a first communication unit 791 provided in the power controller 77 and a second communication unit 793 provided in the second treating apparatus to perform communication with the first communication unit 791.

Although FIG. 4 illustrates that the respective communication units 791 and 793 exchange data with each other in a wireless communication mode, the communication units provided in the present invention may be provided to exchange data in a wire communication mode.

If the second controller C2 is requested from the power controller 77 to reduce the per-hour consumed current amount of the second treating apparatus, the second controller C2 temporarily interrupts the operation of at least some of the respective elements 36, 373, 372 and 325*b* of the second treating apparatus.

Temporary interruption of the operation of at least some of the respective elements of the second treating apparatus may mean that the power is supplied to each element but the operation (application of control command) of the respective elements is interrupted by the second controller C2 through the control circuit L4.

For example, if the second controller C2 receives the control signal through the second communication unit 793, the second controller C2 may control the second driving unit 36 through the control circuit L4 to allow the per-hour current amount input to the stator 361 to reach a minimum value.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

The invention claimed is:

1. A laundry treating apparatus comprising:

a first washing apparatus, the first washing apparatus including:

a first cabinet that has a first inlet on an upper surface of the first cabinet;

a first tub located inside of the first cabinet and configured to store water therein; and a first drum that is located within the first tub, that is configured to receive laundry supplied through the first inlet, and that is configured to rotate within the first tub;

a second washing apparatus, the second washing apparatus including:

a second cabinet arranged at a side of the first cabinet;

a drawer that is located in the second cabinet and that is configured to be drawn into and out of the second cabinet;

a second tub located inside of the drawer and configured to store water therein;

a second inlet located on an upper surface of the second tub; and a second drum that is located within the second tub, that is configured to receive laundry supplied through the second inlet, and that is configured to rotate within the second tub, and a drying apparatus, the drying apparatus including:

a third cabinet that has a third inlet on a front surface of the third cabinet, the third cabinet being mounted on an upper surface of the second cabinet and arranged at a side of the first cabinet;

a third drum that is located inside of the third cabinet and that is configured to receive laundry supplied through the third inlet; and a drying unit configured to supply air to the third drum, wherein the second washing apparatus includes a connector comprising:

a pressurizer located on an upper surface of the second cabinet, wherein the drying apparatus is configured to pressurize and change position of the pressurizer; and a switching unit configured to, based on the position of the pressurizer, open or close a circuit that supplies power to the second washing apparatus.

2. The laundry treating apparatus according to claim 1, wherein the second drum is configured to rotate around a shaft orthogonal to a bottom of the second cabinet, and the third drum is configured to rotate around a shaft parallel with a bottom of the third cabinet.

3. The laundry treating apparatus according to claim 1, wherein the second washing apparatus further includes:

a second driving unit configured to rotate the second drum; and a second controller configured to control the second driving unit;

wherein the connector is configured to allow the second controller to control an operation of the second driving unit based on the drying apparatus being mounted on an upper surface of the second washing apparatus.

4. The laundry treating apparatus according to claim 3, wherein the connector is configured to open or close a circuit, which supplies power to the second driving unit, depending on whether the third cabinet is arranged on the second cabinet.

5. The laundry treating apparatus according to claim 4, further comprising:

a first connector located on a bottom of the third cabinet; and a second connector located on an upper surface of the second cabinet and configured to connect to or detach from the first connector, wherein the first connector is configured to pressurize the pressurizer.

6. The laundry treating apparatus according to claim 1, further comprising:

a second power line configured to supply power to the second washing apparatus;

a third power line configured to supply power to the drying apparatus; and a power controller configured to interrupt power supply to the second power line based on a per-hour current amount supplied to the third power line being a predetermined reference current amount or more.

7. The laundry treating apparatus according to claim 1, further comprising:

a second power line configured to supply power to the second washing apparatus;

a third power line configured to supply power to the drying apparatus; and a power controller configured to transmit, to the second washing apparatus, information that a per-hour current amount supplied to the third power line is a predetermined reference current amount or more based on the per-hour current amount supplied to the third power line being the predetermined reference current amount or more.

8. The laundry treating apparatus according to claim 6, wherein the drying unit includes a heat exchanger and a fan configured to supply heated air to the third drum, and the reference current amount is set to a value less than a per-hour current amount required for the operation of the heat exchanger and the fan.

9. The laundry treating apparatus according to claim 7, further comprising a second controller configured to supply power to the second washing apparatus and configured to temporarily interrupt operation of the second washing apparatus based on the per-hour current amount supplied to the third power line being the reference current amount or more.

10. The laundry treating apparatus according to claim 9, wherein the second controller is configured to perform wired or wireless communication with the power controller.

11. A laundry treating apparatus comprising:

a first washing apparatus, the first washing apparatus including:

a first cabinet that has a first inlet on an upper surface of the first cabinet;

a first tub located inside of the first cabinet and configured to store water therein; and a first drum that is located within the first tub, that is configured to receive laundry supplied through the first inlet, and that is configured to rotate within the first tub;

a second washing apparatus, the second washing apparatus including:

a second cabinet arranged at a side of the first cabinet;

a drawer that is located in the second cabinet and that is configured to be drawn into and out of the second cabinet;

a second tub located inside of the drawer and configured to store water therein;

a second inlet located on an upper surface of the second tub;

a second drum that is located within the second tub, that is configured to receive laundry supplied through the second inlet, and that is configured to rotate within the second tub;

a second driving unit configured to rotate the second drum; and a second controller configured to control the second driving unit, and a drying apparatus, the drying apparatus including:

a third cabinet that has a third inlet on a front surface of the third cabinet, the third cabinet being mounted on an upper surface of the second cabinet and arranged at a side of the first cabinet;

a third drum that is located inside of the third cabinet and that is configured to receive laundry supplied through the third inlet; and a drying unit configured to supply air to the third drum, wherein the second washing apparatus includes a connector comprising:

a pressurizer located on an upper surface of the second cabinet, wherein the drying apparatus is configured to pressurize and change position of the pressurizer; and a switching unit configured to, based on the position of the pressurizer, open or close a circuit that connects the second controller with the second driving unit.

12. The laundry treating apparatus according to claim 1, wherein an entirety of the first inlet is located at a level between a lowest end of the third inlet and an uppermost end of the third inlet.

13. The laundry treating apparatus according to claim 1, wherein more than half of the first inlet is located at a level between a lowest end of the third inlet and an uppermost end of the third inlet.

* * * * *